US010499725B2

(12) United States Patent
Kamm

(10) Patent No.: US 10,499,725 B2
(45) Date of Patent: Dec. 10, 2019

(54) APPLICATOR WITH BRISTLES OF PARTICLE-FILLED PLASTIC

(71) Applicant: GEKA GmbH, Bechhofen (DE)

(72) Inventor: Wolfgang Kamm, Dietenhofen (DE)

(73) Assignee: GEKA GmbH, Bechhofen (DE)

( * ) Notice: Subject to any disclaimer, the term of this patent is extended or adjusted under 35 U.S.C. 154(b) by 527 days.

(21) Appl. No.: 15/500,667

(22) PCT Filed: Jul. 31, 2015

(86) PCT No.: PCT/EP2015/067694
§ 371 (c)(1),
(2) Date: Jan. 31, 2017

(87) PCT Pub. No.: WO2016/016436
PCT Pub. Date: Feb. 4, 2016

(65) Prior Publication Data

US 2017/0231377 A1 Aug. 17, 2017

(30) Foreign Application Priority Data

Jul. 31, 2014 (DE) ..... 20 2014 103 564
Jul. 31, 2014 (DE) ..... 20 2014 103 565
Jul. 31, 2014 (DE) ..... 20 2014 103 567

(51) Int. Cl.
*A46B 9/02* (2006.01)
*A46D 1/00* (2006.01)
*A46B 3/18* (2006.01)

(52) U.S. Cl.
CPC ..... *A46B 9/021* (2013.01); *A46B 3/18* (2013.01); *A46D 1/023* (2013.01); *A46D 1/0207* (2013.01);
(Continued)

(58) Field of Classification Search
CPC ..... A46B 9/021; A46B 2200/1053; A46D 1/0207; A46D 1/023; A46D 10/2038; A46D 1/0246; A46D 1/0261; A46D 1/0276
See application file for complete search history.

(56) References Cited

U.S. PATENT DOCUMENTS 4,733,425 A * 3/1988 Hartel ..... A45D 40/265 132/218
4,964,429 A 10/1990 Cole
(Continued)

FOREIGN PATENT DOCUMENTS

DE 29700611 U1 3/1997
DE 10130863 A1 2/2003
(Continued)

*Primary Examiner* — Dung Van Nguyen

(57) ABSTRACT

A mascara brush with a core comprising at least two sections of wire twisted together along a wire core longitudinal axis and a set of bristles comprising bristles of plastic formed by filaments, which are respectively clamped between the two sections of wire and are formed at their free ends with a wedge-shaped bristle tip or without a wedge-shaped bristle tip. The mascara brush provides an increased storage capacity for the mascara composition to be applied with improved delivery of stored mascara composition to the lashes. This is achieved by the bristles being formed from a plastic material extruded into a fibre, to which outwardly protruding particles are added and/or which is provided with punctiform depressions (indentations), which roughen the bristle surface, wherein the bristles that have a wedge-shaped bristle tip at their free ends comprise at least one cut surface that forms a wedge and the surface roughness of which lies between 0.2 μm and 6.3 μm, in particular between 2.9 μm and 6.3 μm.

21 Claims, 5 Drawing Sheets

(52) U.S. Cl.
CPC ..... *A46D 1/0238* (2013.01); *A46D 1/0246* (2013.01); *A46D 1/0261* (2013.01); *A46D 1/0276* (2013.01); *A46B 2200/1053* (2013.01)

(56) References Cited

U.S. PATENT DOCUMENTS

| | | | | |
|---|---|---|---|---|
| 5,161,554 | A | 11/1992 | Fitjer | |
| 5,161,555 | A | 11/1992 | Cansler et al. | |
| 6,163,918 | A * | 12/2000 | Weihrauch | A46D 1/00 15/207.2 |
| 6,311,359 | B1 | 11/2001 | Brezler, III | |
| 6,391,445 | B1 * | 5/2002 | Weihrauch | A46D 1/00 428/370 |
| 6,669,389 | B2 | 12/2003 | Gueret | |
| 7,089,946 | B2 * | 8/2006 | Rousselet | A46B 3/18 132/218 |
| 2002/0182409 | A1 * | 12/2002 | Gueret | A46B 13/001 428/364 |
| 2004/0011375 | A1 | 1/2004 | Dumler | |
| 2014/0020197 | A1 * | 1/2014 | Nakamura | D01F 6/62 15/160 |

FOREIGN PATENT DOCUMENTS

| | | | |
|---|---|---|---|
| DE | 10232589 | A1 | 1/2004 |
| DE | 202013009431 | U1 | 3/2015 |
| EP | 1264562 | A1 | 12/2002 |
| EP | 2710921 | A2 | 3/2014 |
| JP | 2008307304 | A | 12/2008 |

* cited by examiner

APPLICATOR WITH BRISTLES OF PARTICLE-FILLED PLASTIC

FIELD OF THE INVENTION

The invention is directed to a mascara brush with an inner core of at least two wire portions twisted together along a longitudinal wire core axis and with a bristle covering of bristles of plastic formed by filaments that are each held clamped between the two wire portions and that are configured at their free ends with a wedge-shaped or without a wedge-shaped bristle tip.

BACKGROUND OF THE INVENTION

Applicators of this type are also referred to as wire core applicators.

These applicators are still greatly appreciated today, because not only do they afford advantages with regard to their application, but also have various advantages in production that cannot be achieved with the injected applicators that compete with them. For example, small series can also be manufactured rather effectively because as a rule, very different wire core applicators can be produced on the existing production systems without considerable sums having to be invested in new tools for the one special applicator, unlike for injected applicators.

In general, it also applies to wire core applicators that they are supposed to meet two requirements, in particular:

Their bristle covering is supposed to have as great a mass storage capacity as possible so that the applicator needs to be dipped into the cosmetics supply only once or only a few times in order to envelop the eyelashes with a sufficiently voluminous layer of mascara mass.

On the other hand, their bristle covering is supposed to have as good a separation capacity as possible, i.e. the capacity of separating obliquely overlying eyelashes of the curve of the eyelashes and aligning them in a largely parallel manner. The reason for this is not least that the eyelashes can only be provided with the desired volume by means of the mascara mass if they are each coated all around individually, and not already previously drenched and stuck together in clumps with mascara mass.

In general, it thus applies to wire core applicators that they are supposed to meet high requirements, in particular, for the mass storage capacity with regard to the substance that is to be applied with them.

In the present case, however, the point is not only to increase the mass storage capacity to such an extent that the applicator does not have to be dipped in anew and recharged all too often during the application of mascara. The primary additional point is to ensure also that an eyelash is wetted as intensively as possible with mascara mass during an application process in order to instantly make the eyelashes appear as voluminous as possible in this manner—without having to coat the eyelashes several times and, in the process, take the risk that the separating action suffers and that adjacent eyelashes still stick together at some point due to the multiple application of mascara.

The approach to achieve this is to provide the mascara applicator with bristles that, each for itself, carries as thick a film of mascara mass as possible after dipping them into the mascara supply.

The U.S. Pat. No. 6,311,359 has already proposed in the prior art how to produce bristles for paintbrushes for painting walls and ceilings that, each for itself, is able to carry as thick a paint film as possible. For this purpose, particles (of a most frequently inorganic nature) that roughen the surface of the filaments used later as bristles considerably, because the particles protrude in each case over the surface directly surrounding them, are added to the plastic material prior to extruding the thread or the fiber from which the filaments are cut that later form the bristles.

Instead of for paintbrushes, such bristles can also be used in mascara applicators. However, the practical implementation shows that these particular bristles that provide the respective brush with a superior application behavior when used in paintbrushes do not provide any major improvements when incorporated into mascara applicators.

The reason for this may be found in the different covering density, and may primarily be that the mechanism causing the discharge of the paint is a totally different one in a paintbrush to that in a mascara applicator. A paintbrush is pressed against the surface to be coated with the paint with some force, which triggers the discharge of the generally rather highly liquid paint that adheres to the bristles.

This is different in a mascara applicator. Here, the bristles are not pressed against the eyelashes while exerting a force; rather, the eyelashes slide into the interspaces between the bristles and only touch the bristles.

Therefore, it is clear why it is possible that the bristles, which are roughened by admixing the particles and are therefore provided with a better mass storage capacity, are unable to provide the superior effect when used in a mascara applicator that they are able to provide in paintbrushes.

In order to improve the combing result of a mascara brush, and thus the application of mascara, DE 102 32 589 A1 proposed to configure the bristle tips in a tapering manner with a wedge-shaped cross section.

SUMMARY OF THE INVENTION

The invention is based on the object of providing a solution that provides a mascara brush with an increased mass storage capacity for the mascara mass to be applied, with an improved discharge of stored mascara mass to the eyelashes at the same time.

In a mascara brush of the type referred to in more detail in the introduction, this object is achieved, according to the invention, by the bristles being formed from a plastic material that is extruded to form a fiber and to which outwardly protruding particles are added, and/or that is equipped with point-shaped depressions (indentations) that roughen the bristle surface, wherein the bristles having at their free ends a wedge-shaped bristle tip comprise at least one cut face (4) which forms a wedge and whose surface roughness (Rz) is between 0.2 μm and 6.3 μm, in particular between 2.9 μm and 6.3 μm.

The surface roughness Rz, which is also referred to as roughness depth, is to be determined in accordance with DIN EN ISO 4287/4288.

By the addition of the particles or the formation of point-shaped depressions or indentations in the outer surface of a bristle, as well as, in particular, by forming wedge-shaped cut faces, which improve combing, with the indicated roughness Rz between 0.2 μm and 6.3 μm, in particular between 2.9 μm and 6.3 μm, the mascara accommodating capacity of each bristle, and in particular of each bristle cut in a wedge-shaped oblique manner, is improved. In this case, it is particularly advantageous that, due to the roughness according to the invention, the obliquely extending cut faces have a good mascara accommodating capacity and, thus, also a correspondingly good mascara discharging capacity to the eyelash hairs that first slide along them during the combing process. Thus, the cut faces are of particular importance since, during the make-up process, the eyelashes are first guided along this surface and slide along it at the beginning of the make-up movement.

In one embodiment, the invention provides that the surface roughness (Rz) is produced by grinding the bristle ends by means of a grinding disk. The particles that are at least partially still located under a thin plastic skin after extrusion are exposed by grinding, and thereby, the roughness and, along with it, the mass accommodating and mass storage capacities for mascara mass are improved. In particular, the desired roughness of the oblique cut face can be influenced and determined by selecting the roughness of the grinding disk(s) used during grinding accordingly.

In this way, it also becomes possible to configure the roughness of the cut faces in such a way that the surface roughness (Rz) of the respective cut face is greater than that of the undisturbed bristle shaft surface comprising the outwardly protruding particles and/or point-shaped depressions (indentations), which a development of the invention also provides.

That is, the above-mentioned object is achieved with a mascara brush with an inner core of at least two wire portions twisted together and a bristle covering of bristles formed by filaments. The filaments are each held clamped between the two wire portions. The brush according to the invention is characterized in that the bristles are made of a plastic material to which particles are added which provide the bristle surface with an increased surface roughness, preferably measured as Rz, compared with the surface roughness that a bristle has that has been extruded from the same material but without the addition of particles. The special characteristic of the brush according to the invention is that its bristle covering has bristles that carry at their free ends a wedge-shaped tip instead of an end face extending substantially perpendicularly to the longitudinal bristle axis.

According to another embodiment of the invention, it is therefore useful if the total number of bristles has, for the predominant part, a wedge-shaped tip with at least one cut face.

Advantageously, a part of the bristles then has a wedge-shaped tip, which is formed by an oblique cut, with a cut face, which is also provided by the invention.

As will be explained in greater detail later, the at least one wedge surface with which a bristle can be equipped according to the invention makes it possible to push the bristle between the eyelashes in such a manner, at the beginning of the application, that the respective eyelash better remains in contact with the bristle, even after the eyelash has slipped from the cut face forming the wedge surface into the area of the bristle shaft. Thus, the respective bristle shaft and the cut faces, which keep a thicker film of mascara mass stored due to their increased roughness, are able to discharge more of this mascara mass to the eyelash. Thus, a better coating of the eyelash takes place. Not least, the eyelash volume to be achieved benefits from this.

Preferably, the wedge-shaped tip of the respective bristle is formed by an oblique cut like a simple wedge, so that a first side of the bristle concerned has a maximum longitudinal extent ($L_{MAX}$) and the second side diametrically opposite to it has a minimum longitudinal extent ($L_{MIN}$). A particularly long and, relative to the longitudinal bristle axis, gently sloping wedge surface can thus be produced, which benefits the effect to be utilized according to the invention.

For other cases of application, the wedge-shaped tip can be formed by a double oblique cut, which consists of two surfaces that run towards each other and intersect at the free end of the bristle, at least in their imaginary extension. In this manner, the bristle concerned is able to act on both sides and thus influence two eyelashes at the same time, which have come to lie against the bristle from different sides. In an embodiment, the invention is therefore also characterized in that a part of the bristles has a wedge-shaped tip formed by a double oblique cut, which has two cut faces running towards each other which, or the imaginary extensions of which, intersect at or in the area of the free end of a respective bristle. A bristle configured in this manner is able to push eyelashes away to both sides and thus separate them. Unlike a bristle that is simply obliquely cut, such a bristle does not exhibit an irritating preferred direction.

It is particularly beneficial if the cut faces are substantially planar in themselves. Ideally, two opposite cut faces at the same bristle end substantially have the same size.

The bristles can be orientated in such a way that the one or the two opposite cut face(s) at a bristle tip are disposed transversely to the longitudinal wire core axis, wherein, then, particularly those bristles that are equipped only with a unilateral cut face are disposed and orientated in such a way that a part of the respective cut faces is orientated with an orientation towards the brush tip carrying the bristle covering, and a part is orientated towards the opposite brush end. In another embodiment, the invention is therefore characterized in that the cut faces are orientated transversely, in particular perpendicularly, to the longitudinal wire core axis (LD). Further, it is advantageous in this case if the cut faces of the bristles are, in part, orientated with one cut face in the direction towards the brush end and, in part, towards the brush tip. Accordingly, within the context of this preferred exemplary embodiment, it is provided that the cut face formed by the oblique cut is orientated in such a way that, looking along the longitudinal wire core axis (i.e. looking frontally at the free end of the wire core or frontally at the free end of the wire core provided for attachment to the stem), one looks frontally at the cut face, whereas one does not look at the cut face if one looks in the circumferential direction. Preferably, this applies to all bristles of the covering.

A mascara brush can have several types of bristles configured differently at their bristle tips.

For example, a bristle covering can have, in its entirety, bristles with a tip that is not pointed and not formed in a wedge-shape, and bristles with a bristle tip that is formed in a wedge-shape and has two opposite cut faces, and bristles with a bristle tip that is formed in a wedge-shape but has a cut face only on one side, with the cut faces being orientated in different directions, in one case towards the bristle end and in one case towards the bristle tip. Therefore, it is particularly useful if individual types of bristles are systematically arranged in the bristle covering and are respectively associated with areas, zones or sectors of the bristle covering. In one development, the invention is therefore further characterized in that the bristle covering has several areas, sectors or zones, which are orientated to extend, in the circumferential direction of the bristle covering, transversely, in particular perpendicularly, to the longitudinal wire core axis (LD), or, in the circumferential direction of the bristle covering, spiral-shaped to the longitudinal wire core axis (LD), or, in the longitudinal direction of the bristle covering, alongside of, in particular parallel to, the longitudinal wire core axis (LD), and which respectively comprise at least one bristle row consisting of several adjacent bristles that each have an identically configured bristle tip, or are formed by such a bristle row, and which, in the circumferential direction and/or in the longitudinal direction of the bristle covering, are respectively disposed adjacent to one area or sector or zone which comprises several bristles and whose bristles have, in comparison therewith, a differently configured bristle tip.

In this case, however, it is also possible that the bristle covering has several areas, sectors or zones, which are orientated to extend, in the circumferential direction of the bristle covering, transversely, in particular perpendicularly, to the longitudinal wire core axis (LD), or, in the circumferential direction of the bristle covering, spiral-shaped to the longitudinal wire core axis (LD), or, in the longitudinal direction of the bristle covering, alongside of, in particular parallel to, the longitudinal wire core axis (LD), and which respectively comprise at least one bristle row which consists of several adjacent bristles and whose adjacent bristles each have a differently configured bristle tip.

Thus, for example, of the above-described four types of bristles or of the six bristle types described in this application as a whole, all four or six bristle types can be disposed in each case individually alternately adjacent to each other in an area or a zone or a sector and thus form an area or a zone or a sector. However, it is also possible that only one bristle type is respectively disposed in an area or a zone or a sector and that then, for example in the circumferential direction of the bristle covering, an area or a zone or a sector with a respectively different bristle type respectively follows alternately. Preferably, an area or a zone or a sector comprises at least two bristles. Of course, all logically possible combinations of bristle types and areas, zones and sectors are possible. For example, not all of the four above-mentioned bristle types or all of the six bristle types described herein as a whole have to exist in every zone or every area or every sector or be present, as a matter of principle, in a bristle covering.

The extent of a zone, an area or a sector may vary. In another useful embodiment, the invention therefore provides that the several areas, sectors or zones, in the circumferential direction, transversely or longitudinally to the longitudinal wire core axis (LD), sweep over the circumference or a partial area of the circumference of the bristle covering once.

In principle, an area or a zone or a sector sweeps over an angular distance that constitutes ⅛ to 1/64 of the circumference or of the enveloping circle of the bristle covering, and thus an angular extent between 5.6° and 45°.

With respect to the bristles that are respectively equipped with a beveled cut face, it may be useful to provide, in each case alternately, an area or a sector or a zone in which the cut faces of all bristles are orientated to point in the direction towards the brush tip, and an area or a sector or a zone in which the cut faces of all bristles are orientated to point in the direction towards the brush end. For example, this can be produced by moving, in a first step, a grinding disk over the bristle covering from the brush tip, parallel and alongside the longitudinal wire core axis, to the brush end in order to produce the cut faces, then rotating the bristle covering or the mascara brush by ⅛ of a turn, for example, which corresponds to a rotation by 45°, and then moving the grinding disk in a second step in a direction opposite to the first step from the brush end, parallel and alongside the longitudinal wire core axis, to the brush tip. This sequence of steps is carried out until the grinding disk has moved and swept across the full 360° circumference of the bristle covering once.

Furthermore, it may be advantageous if the bristle covering consists of bristles or filaments with a wedge-shaped pointed portion and consists of further bristles or filaments without a wedge-shaped pointed portion, the bristle covering being preferably configured in such a way that the bristles or filaments with a wedge-shaped pointed portion form one or more sector(s) of the bristle covering and the further bristles or filaments form one or more further sector(s), the sector(s) and the further sector(s) preferably and ideally following each other alternately in the circumferential direction, which an embodiment of the invention also provides.

According to another embodiment of the invention, it is useful if between 1 and 8 sectors and between 1 and 8 further sectors are provided.

In this case, it may further be advantageous that the bristles or filaments with the wedge-shaped pointed portion are disposed in such a way, in the bristle covering that otherwise consists of further bristles or filaments, that they form a track extending in a spiral shape on the circumferential enveloping surface of the bristle covering, which the invention also provides.

Furthermore, it may be useful that the further bristles or filaments are made of the same material as the bristles or filaments with a wedge-shaped pointed portion.

Also in this case, it is advantageous that the chisel faces of the bristles or filaments with a wedge-shaped pointed portion, neglecting their wedge angle, are orientated perpendicularly to the course of the imaginary longitudinal axis of the spiral-shaped track.

It is particularly useful if the angle ($\alpha$) by which the cut face(s) formed by the oblique cut or the double oblique cut is/are inclined relative to the longitudinal bristle axis complies with the relationship $\alpha \leq 55°$, and ideally even $\alpha \leq 35°$. This results in each case in a particularly long cut face well-suited for use, because it slopes only gently relative to the longitudinal bristle axis. Compliance with the relationship $\alpha \leq 20°$ has proved to be absolutely ideal.

Preferably, this is associated with a so-called double grinding, i.e. one and the same cut face is ground for a first time and then, in a separate working step, a second time, whereby such a steep angle can be obtained. Therefore, the invention is further characterized in that, for the angle by which the cut face(s) formed by the oblique cut or the double oblique cut is/are inclined relative to the longitudinal bristle axis, the relationship is $\alpha \leq 55°$, preferably $\alpha \leq 35°$, in particular $\alpha \leq 20°$.

The filaments forming the bristles can have a non-round cross section, and preferably a polygonal or quadrilateral cross section.

Surprisingly, it was found to be particularly beneficial to configure the bristles or filaments in a tube-shaped, internally hollow manner, preferably over the entire length (prior to twisting). This results in a particularly beneficial synergistic effect, particularly if the oblique cut is produced by grinding the bristles. If the bristle is internally hollow, it is capable of storing mascara mass with its cavity, which is discharged during application to the outside via the mouth of the cavity, which is located right in the center of the cut face. As a result, the eyelashes are already pre-coated as they slide along the cut face, which further improves the application of mascara as a whole. An essential point is in this case that the oblique cut, or the wedge surface produced thereby, causes the mouth of the internally hollow bristle to become significantly larger and thus creates a larger area in which mascara mass can be stored in such a way that it is immediately available for discharge upon application, and that mascara mass that is stored slightly deeper in the bristle interior can also be discharged more easily via the greater area of the mouth. In addition, the cut face of the bristles produced by the oblique cut forms a large contact area, which the individual eyelash can slide along for a fairly long time before it slips off the end face of the bristle and comes to lie between adjacent bristles. Meanwhile, the eyelash has ample opportunity for being wetted with mascara mass. The individual eyelash is capable of remaining only for a much shorter time on a small-surface end face extending substantially perpendicular to the longitudinal bristle axis of a hollow bristle, before it slips into the spaces between the bristles. Therefore, in another embodiment, the invention also provides that the bristles or filaments are configured to be tube-shaped and internally hollow, as well as continuously slit in the direction along their longitudinal axis. It is beneficial to configure the bristles or filaments to be continuously slit in the direction along their longitudinal axis. In this manner, the bristles or filaments become slightly more unstable, or their stability can be controlled better, so that during application, the bristles are deformed more strongly in such a way that mascara mass stored in their cavity is discharged via its mouth in the area of the oblique cut.

Preferably, the outer diameter of bristles 1 with a circular configuration is ≥115 μm, and even better ≥215 μm. In the predominant number of cases, the outer diameter of the bristles 1 with a circular configuration used in the invention is ≤320 μm. In an embodiment, the invention is therefore also characterized in that the outer diameter of bristles with a circular configuration is ≥115 μm, preferably ≥215 μm, and ≤320 μm.

Where the bristles are non-circular, it applies that the outer enveloping circle of bristles configured to have a non-circular cross section has an enveloping circle diameter which is ≥100 μm, and better still ≥200 μm. In the predominant number of cases, the outer enveloping circle of the bristles with a non-circular configuration used in the invention is ≤340 μm, and better still, ≤320 μm. Finally, the invention is characterized in that the outer enveloping circle of bristles configured to be non-circular has an enveloping circle diameter which is ≥100 μm, preferably ≥200 μm, and ≤340 μm, in particular ≤320 μm. The enveloping circle is to be understood to be the circle into which the respective cross section of the bristle can be plotted with the best fit.

Both the outer diameter of the bristles and the enveloping circle diameter are configured to be ≤340 μm, in particular ≤320 μm, because the bristles would otherwise become so coarse that their capacity for separating the eyelashes is limited too much.

Where the bristles are hollow, the wall thickness of the bristles 1 used, which is measured perpendicularly to the outer surface, can be between 15 μm and 100 μm. The wall thickness of the bristles, or of their bristle jacket which delimits the cavity inside the bristle, is in each case selected such that the hollow bristle, under the influence of the forces typically occurring during application, undergoes sufficiently strong deformation to press the mass stored in its interior towards the outside.

It has proved to be particularly beneficial if the corners of the radially outward bristle tips are rounded.

Alternatively, but not preferably, or additionally, the effect improving the mass accommodating capacity can also be obtained by so-called indentations, i.e. point-shaped depressions, instead of by particles protruding locally from the surface, i.e. by a plurality of local depressions in the bristle surface which, seen microscopically or greatly enlarged, provide the bristle surface with a profile like a crispbread and thus make it more absorbent. Advantageously, the number of indentations or point-shaped depressions or impressions distributed over a respective bristle is greater than 200.

A further need for optimization may exist if the wire core applicator has a particularly dense bristle covering. In that case, it is basically clear that the separation capacity of the bristles can be increased further by producing the bristles from as hard a material as possible, which provides the bristle with a higher rigidity or buckling strength with the same diameter, and thus causes two positive effects. A rigid bristle is inherently better capable of penetrating between overlying eyelashes of the curve of the eyelashes. In addition, a rigid bristle has a much smaller tendency to evade the grinding disk, and therefore offers the possibility of a more pronounced grinding of the tips than a softer bristle. However, the attempt to use hard materials and, in particular, hard plastic materials reveals the problem that the quality of the outer edge of the ground surface can decline during grinding. The problem may occur that the edge no longer forms a clean continuous line but possibly exhibits a ragged contour, which may impede the sliding of the eyelashes along the edge. In order to avoid this, it may be provided that the bristles are made from two different plastics; that they have a bristle jacket of a first, softer material and a bristle core, which is connected to the bristle jacket, of a second, harder material.

Since bristles that are as hard as possible and, at the same time, slender are advantageous for separating the eyelashes as efficiently as possible, it would as such have been obvious to produce the jacket of the filament or the jacket of the bristles from the harder material, and not the core. This reason for this is that the radially outward areas of a cylinder are known to contribute much more to the bending rigidity than the central or core area of a cylinder located close to the neutral fiber. However, it was found that the core also provides the filament or the bristles formed by the filament with a greater bending rigidity, even when the bristle ends are ground to a generous extent and in the process lose the predominant part of their original jacket in the ground area. The hard core, which is preserved to a good extent even during grinding, simplifies making the free bristle ends pointed in as flat a manner as possible by grinding them, for it prevents the bristles from being able to evade the grinding disk all too easily, thus coming into contact with the grinding disk with insufficient intensity, so that they are efficiently ground and, above all, ground over a considerable length. Thus, the above-described embodiment of the bristles makes it much easier to provide the respective bristle end with as flat a wedge angle as possible and at least with as long a wedge surface as possible.

On the other hand, the behavior of the soft jacket supported by the hard core is exceptionally non-problematic during grinding, and it surprisingly forms a well-defined outer edge, free from fraying and/or chipping, i.e. irregularities that the individual eyelashes could hook into when the pointed bristle end penetrates the eyelash cover, which could affect the separation result adversely.

It can be advantageous if the predominant part of the filaments or bristles of the bristle covering is made from such a material mix and structure. For example, a certain number of filaments, e.g. thinner filaments, which frequently forms a minority and which consists of only a single material in each case, may be among the filaments that, for example, form the bristle covering or the brush covering. These are preferably filaments that are consistently made from the softer material also used for the ground filaments.

It can be provided that at least 75% of all filaments, and ideally even all of the filaments used for a mascara applicator, are made from the claimed material mix.

The first and preferably also the second material can be a plastic, ideally a thermoplastic plastic.

The two plastics can be firmly bonded to each other by co-extrusion, and the filaments can be sections of a continuously co-extruded thread or several continuously co-extruded threads. In this case, co-extrusion is not simply an arbitrary, exchangeable method, but embosses the continuous thread, and thus also the filaments cut from it, and in turn the bristles formed therefrom, with its particular microstructure. On the one hand, this microstructure is characterized in that the two different plastic materials are glued or welded or fused with each other particularly intimately and, on the other hand, that their plastic molecule chains have a significant orientation in the direction of the longitudinal axis, which later forms the longitudinal bristle axis.

As the second material, such a material is to be preferred which has a modulus of elasticity (E modulus) of at least ≥1300 N/mm$^2$. It is significantly better if the second material has an E modulus of at least ≥1700 N/mm$^2$. For most cases of application, it is advisable if the E modulus of the second material does not exceed 2700 N/mm$^2$.

It may be beneficial to incorporate polyamide 6.12 into the bristle core as the first material. In this case, the first material may have a Shore D hardness of ≤80. The method for measuring the Shore hardness D is standardized; the relevant standards are the standards DIN EN ISO 868 and DIN ISO 7619-1.

In a filament or bristle coextruded from two different plastics having the above characteristic parameters, there is also the advantage that the grinding of the cut faces with one and the same grinding disk results in different roughnesses in the above-mentioned rowdiness depth range at the jacket and the core components of the coextruded bristles, due to the different E modules, with these different roughness depths, however, furthermore fulfilling the two most important functions of a bristle, i.e. the separation and combing of the eyelashes and the simultaneous wetting of the eyelashes during an application movement.

BRIEF DESCRIPTION OF THE DRAWINGS

Further mechanisms of action, advantages and optional embodiments are apparent from the following description of some exemplary embodiments with reference to the Figures. The invention is explained below in more detail by way of example with reference to a drawing. The latter shows in.

DETAILED DESCRIPTION OF THE INVENTION

Figure 9:
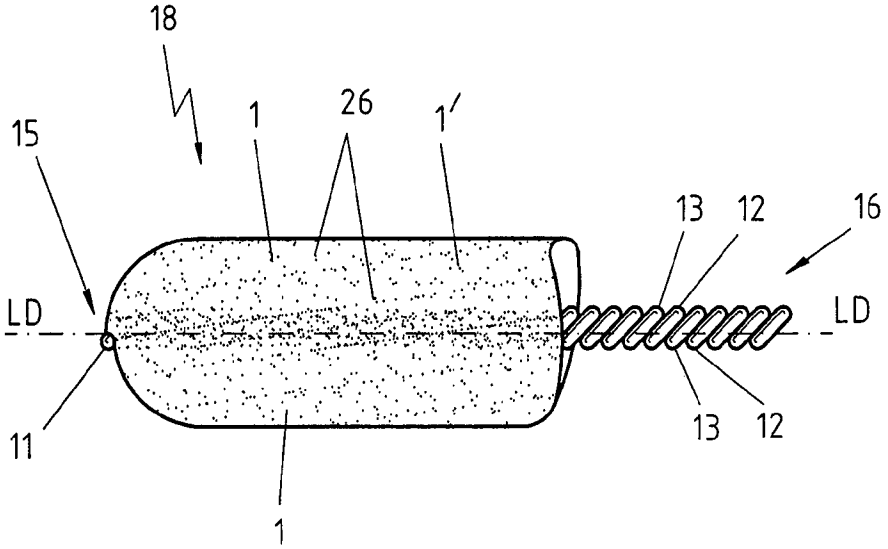

The mascara brush designated as a whole with the number 18, which is illustrated in FIG. 9 with its front region comprising the brush tip 15, is produced by placing a plurality of, at first, mostly straight filaments 1' between at least one wire clamp 11 with two straight wire portions 12, 13. Preferably, a portion of a continuously extruded fiber is referred to as a filament 1' in the sense of the invention. Generally, the filaments 1' are placed between the wire sections 12, 13 of the wire clamp 11 in such a way that they protrude to a substantially equal extent (preferably maximally +/−10%) on both sides of the wire clamp 11 or of its wire portions 12, 13.

The wire portions 12, 13 are then twisted together, whereby the filaments 1' are distributed and then firmly clamped between the wire portions 12, 13. Generally, each filament 1' forms two bristles 1. Thus, it is only "different sides of the same coin" that are addressed within the context of this description when the term "filament" is used at one time and the term "bristle" at another time.

After twisting, while the brush 18 is rotating, the brush contour, i.e. the enveloping jacket surrounding the bristle covering 26 of the mascara brush 18, is cut by means of a milling cutter and a counter blade in such a way that the plurality of the radially protruding bristles 1 corresponds to a predetermined brush body, exactly according to the drawing. In a next step, the bristles are then beveled according to the invention, in particular by grinding.

Figure 2:
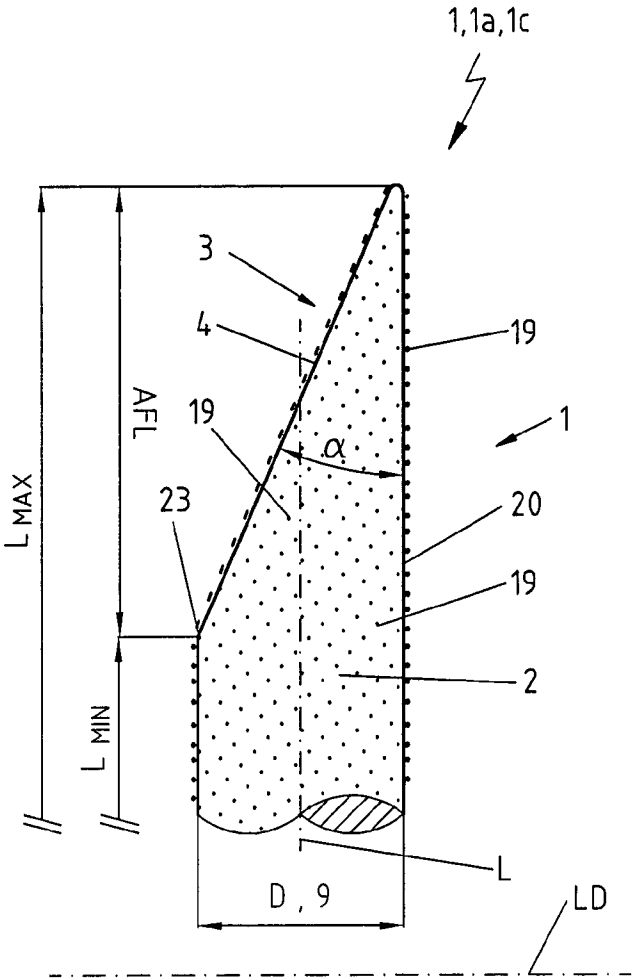
Figure 1:
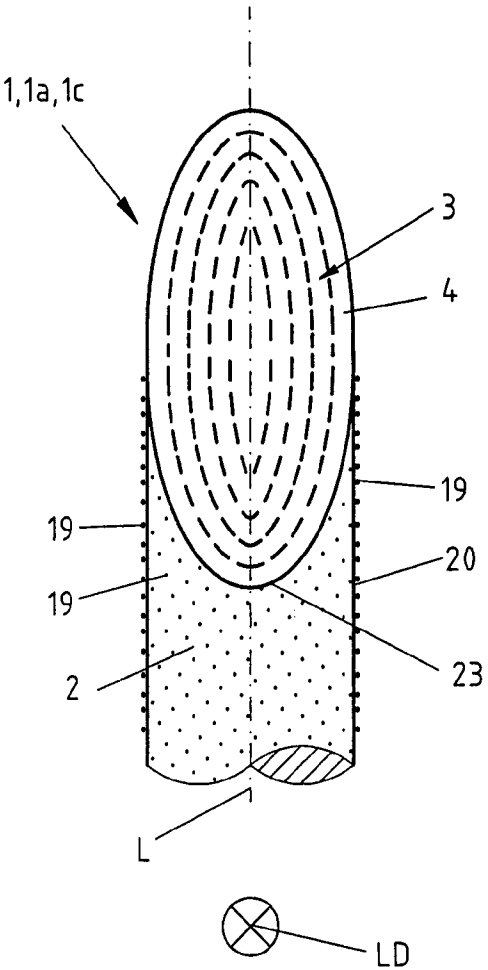
FIG. 1 a bristle configured in accordance with the invention in a top view onto its (single) oblique cut, FIG. 2 the bristles according to FIG. 1 in a side view, FIG. 3 the bristle according to FIG. 2 shortly after penetrating the eyelash covering, FIG. 4 the bristle according to FIG. 2 shortly before the eyelash reaches the bristle stem from the cut face, FIG. 5 a second exemplary embodiment of a bristle whose bristle tip has a double oblique cut, FIG. 6 a third exemplary embodiment of a bristle configured to be hollow and provided with a longitudinal slit, FIG. 7 a sectional view perpendicular to the longitudinal bristle axis, in the area of the bristle shaft underneath the oblique cut in the exemplary embodiment according to FIG. 6, FIG. 8 an alternative embodiment of an oblique cut, FIG. 9 a mascara brush equipped in accordance with the invention, FIG. 10 a bristle arrangement with alternately pointed and non-pointed bristles, in a partial detail of a cross section through the bristle covering in the viewing direction onto the brush tip, FIG. 11 an enlarged detail from FIG. 10, and in FIG. 12 a detail of the bristle variant shown in FIGS. 10 and 11, seen frontally froth the front.

FIGS. 1 and 2 show the details of an exemplary embodiment of a bristle 1*a*, 1*c* cut obliquely.

It is possible to see the particles 19 that have been added to the plastic mass that is extruded to form the thread or fiber from which the filaments 1' forming the bristles 1, 1*a*, 1*c* are cut. Which particles 19 can be used and how the preparation of a corresponding plastic mass works from which such threads, which are later to be cut into filaments 1', can be extruded, is described in the U.S. Pat. No. 6,311,359, whose content of disclosure is included in the subject matter of this application by reference. In particular, protection is sought within the context of this application also for the substances described therein as a suitable material for producing the particles.

In the area close to the surface, the particles 19 are only partially embedded into the plastic matrix forming the filament 1' and in part protrude towards the outside, over the surface 20 surrounding them. Thus, they create a significantly increased surface roughness. In the broadest sense, the surface 20 is easier to wet for the mascara mass.

Because of the roughness being increased in this manner, the mascara mass has a much better purchase on the surface 20 of the bristle shaft 2, so that a thicker film of mascara mass adheres to the surface 20 of the bristle shaft 2 after wiping than to the almost totally smooth surface of the bristle shaft of a bristle extruded from a plastic mass to which no plastic particles have been added.

As is easily recognizable, the bristle 1, 1*a*, 1*c* has at its free end an oblique cut 3, which here forms a cut face 4 that forms a wedge, which will be addressed in detail later.

In the case of such an oblique cut 3, the cut face 4 is preferably orientated in such a way that, looking along the longitudinal wire core axis LD, one looks frontally at the cut face 4, as is shown in FIG. 1, whereas one does not, or not to any noteworthy extent, look at the cut face 4 if one looks in the circumferential direction, as shown in FIG. 2. In this case, however, a part of the cut faces 4 is orientated in the direction towards the brush tip 15, i.e. the cut faces 4 formed in the bristles 1*c*, and a part of the cut faces 4 is orientated towards the brush end 16, i.e., the cut faces 4 formed in the bristles 1*a*.

The aspect crucial for the invention is the surprising synergistic cooperation between the wedge formed by the oblique cut 3 and the bristle shaft 2, which are able to store a particularly thick film of mascara mass due to their increased roughness.

To the extent it is understood in detail so far, the effect obtained with the invention can best be explained with reference to FIG. 3.

Figure 3:
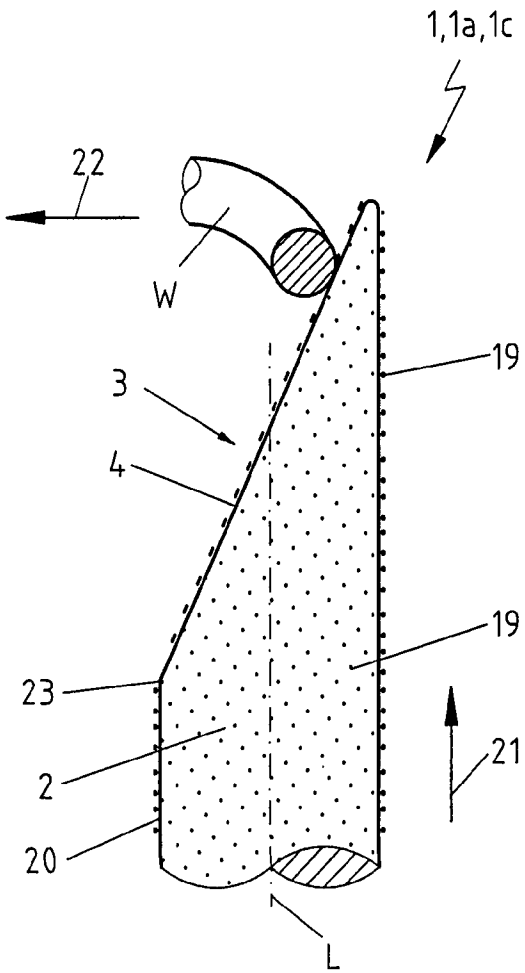

The applicator covered, according to the invention, with the bristles 1, 1*a*-1*f*, i.e. the mascara brush 18, is generally brought up to the curve of the eyelashes in such a way that the bristles 1, 1*a*-1*f* are moved in a direction that extends approximately perpendicularly to the "longitudinal axes" of the eyelashes W, see FIG. 3, where the direction in which the bristle 1, 1*a*-1*f* approximately moves is illustrated by a first vertical arrow 21. Together with the remaining material, the oblique cut 3 forms a kind of "wedge" in the obliquely cut bristles 1*a*, 1*c*-1*f* that pushes itself between adjacent bristles and that, in any case, pushes the eyelash W, which comes, to rest on the cut face 4 formed by the oblique cut 3, more and more towards the side the deeper the "wedge" is pushed between the eyelashes. The direction in which the eyelash W is pushed aside is illustrated in FIG. 3 by a second horizontal arrow 22.

The eyelash W put up increasing resistance against being pushed aside by tending to attempt to spring back into its original position. Thus, it abuts the cut face 4 with a certain bias, whereby a permanent contact between the eyelash W and the cut face 4 is ensured.

Figure 4:
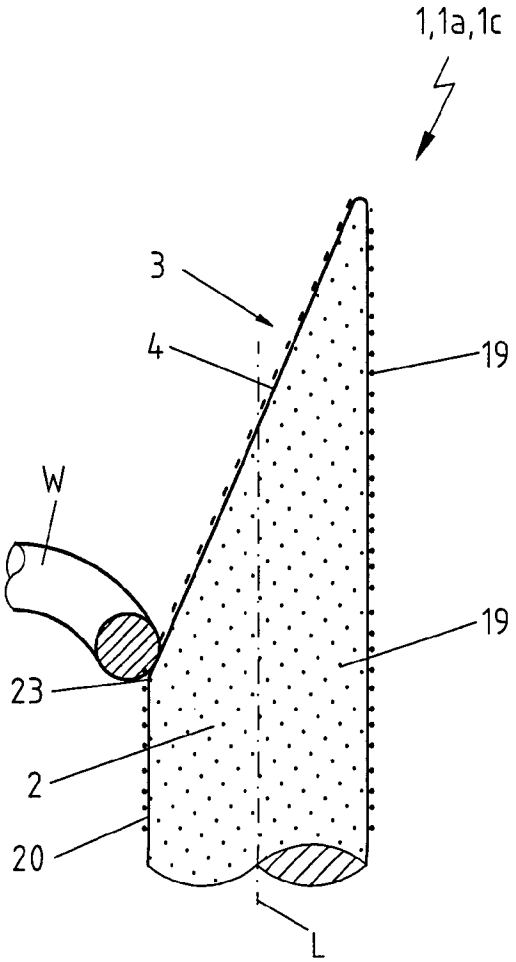

The crucial point is now that, though not in all cases but in many cases, said "bias" between the eyelash W and the bristle 1, 1*a*, 1*c*-1*f* remains beyond the moment at which the eyelash W has reached the inward end 23 of the cut face 4 and now slips along the surface 20 of the bristle shaft 2, deeper into the interspace between the bristles of the bristle covering, see FIG. 4. Thus, the eyelash W does not disengage from the bristle 1 that has pushed it aside in order to fall or "snap", more or less "freely", into the interspace between adjacent bristles. Instead, it slides further along the bristle shaft 2 to which a thicker mascara film adheres due to its increased roughness. Thus, the eyelash W is coated particularly well with the mascara mass while sliding along the bristle shaft 2.

This surprisingly simple measure solves the previously exiting problem, namely that, though the bristle known from the paintbrush with its increased surface roughness also exhibits a significantly higher storage capacity also when used as a bristle for a mascara applicator, it has only a poor capacity for discharging the stored mass because the bristle covering in a mascara applicator or a mascara brush 18, unlike a paintbrush, is not "squeezed" out at the location where the paint is to be applied.

Having thus illustrated the operating principle that the invention is to utilize, the details of the bristle design must still be addressed.

In the exemplary embodiment shown in the drawing in FIGS. 1 and 2, the bristle 1, 1*a*, 1*c* has a circular cross section. At its radially outward free end distal relative to the longitudinal wire core axis, the bristle 1, 1*a*, 1*c* has an oblique cut 3 like a simple wedge. This means that a first side of the bristle 1, 1*a*, 1*c* concerned, seen in the direction along the longitudinal bristle axis L, has a maximum longitudinal extent $L_{MAX}$ and the second side diametrically opposite to it has a minimum longitudinal extent $L_{MIN}$. Thus, one side or one strip of the surface 20 of the bristle 1, 1*a*, 1*c* is longer than the side diametrically opposite to it or a strip of the surface 20 diametrically opposite to it, see FIG. 2.

Figure 5:
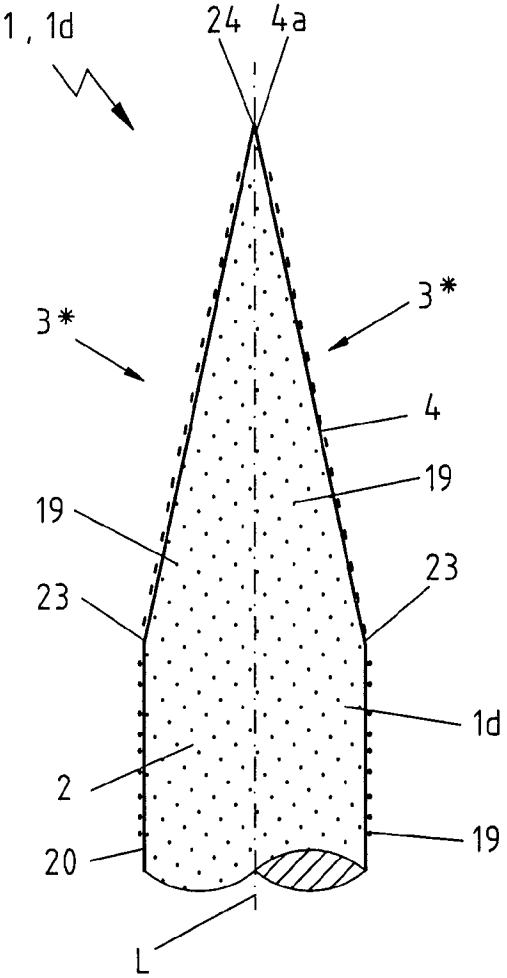

In this case, the bristle 1, 1*a*, 1*c* is, in any case, not only "slightly" obliquely cut, but exhibits a clearly recognizable oblique cut 3. Preferably, the angle by which the cut face 4 formed by the oblique cut 3 is inclined relative to the longitudinal bristle axis L complies with the relationship $\alpha \leq 55°$, and ideally even $\alpha \leq 35°$. It is ensured in this manner that the cut face 4 is sufficiently large to obtain the effect intended by the invention, once again see FIG. 2. Bristles 1, 1*d* with $\alpha \leq 20°$ can also be produced particularly by double grinding, as was explained above, during which two cut faces 4 opposite to each other are produced, as is shown in FIG. 5.

Not only because of this, the result is a very pronounced cut face 4, which preferably has such a length that it extends over at least 1/10, better yet over at least 1/6 of the total length of a bristle 1, 1*a*-1*f*. In other words, it can be said that it is particularly beneficial for many cases of application if the following relationship is complied with:

$L_{MAX} \leq L_{MIN}$+½×filament diameter or bristle diameter 9, D to $L_{MIN}$+2×filament diameter or bristle diameter 9, D. With said additional grinding, this can be increased to up to $L_{MAX} \leq L_{MIN}$+4×filament diameter or bristle diameter 9, D—as can be seen in FIG. 2, which in this respect is not drawn to scale, referring to the cut face length AFL dimensioned there.

It is ensured in this manner that the respective cut face 4 is sufficiently large to obtain the effect intended by the invention.

However, the effect utilized by the invention for improving the contact between the eyelashes and the respective bristle shaft 2 can not only be obtained by means of a simple oblique cut 3, even if that is preferred due to its particularly long wedge surface.

At least in less problematic cases, a double oblique cut 3* may also be used, as it is shown in FIG. 5. Such a double oblique cut 3* is formed of two cut faces 4 which run towards each other and which, or the extensions of which, intersect at the free end of the bristle 1, 1*d* and there. form a type of "chisel cutting edge" 4*a*, i.e. a generally substantially straight edge 24—except for tolerance deviations—that constitutes the outermost end of the bristle 1*d*. Thus, such a double oblique cut 3* provides the free end of a bristle 1, 1*d* with a chisel-like or roof-like appearance.

Otherwise, such a bristle 1*d* corresponds to the exemplary embodiment described by the FIGS. 1 and 2 as regards its body and its action, so that the statements there also apply to the exemplary embodiment according to FIG. 5. This applies particularly to the angle α by which the two cut faces 4 are inclined relative to the longitudinal bristle axis L.

Figure 8:
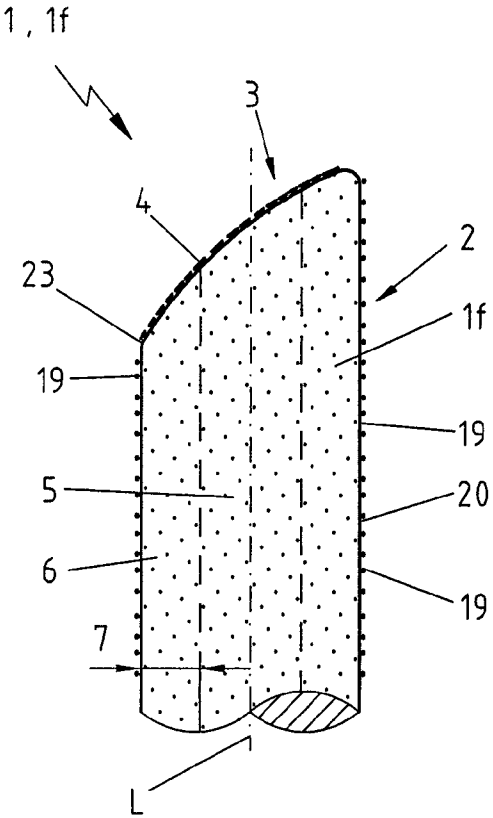

It must be noted that FIGS. 1 and 2 show an optional exemplary embodiment whose cut face 4 is substantially planar, i.e. level in itself. Another embodiment optionally preferred for certain cases of application is illustrated in FIG. 8, which, in addition, shows a bristle 1*f* produced from two different plastic materials. The cut face 4 of this bristle 1*f* is convexly curved in two mutually perpendicular directions, for example like a pocket watch glass. Surprisingly, tests have shown that such a convex curvature significantly improves the discharge of the stored mascara mass and the wetting of the eyelashes sliding past even more.

For the purpose of clarification, it is noted that the terms "oblique cut" or "double oblique cut" in the sense of the invention are not to be understood to mean that the wedge surface(s) need(s) to have been produced by a cutting process, i.e. by "obliquely cutting" the filament. Rather, each wedge surface may also have been produced by correspondingly grinding the bristle end, which is actually the preferred manufacturing method.

If the, oblique cut 3 or the double oblique cut 3* are produced by grinding, this results in the particles 19 embedded into the plastic mass in the area of the cut faces 4 being liberated from their outer thin plastic sheath, which is present after extruding, and possibly also being ripped out of the plastic mass, so that point-shaped depressions or indentations are produced. This means the respective cut face 4 itself has an excellent surface roughness (Rz) that is between 0.2 μm and 6.3 μm, in particular between 2.9 μm and 6.3 μm, and that is capable of storing a sufficient amount of mascara mass, possibly even relatively, i.e. per unit area, more than the bristle shaft 2, which is rough due to the particles.

In order to obtain a further improvement beyond this, two measures are basically conceivable that are in each case to be realized optionally.

At the one hand, it may be useful, during the production of the oblique cut 3 or of the double oblique cut 3*, to select a grinding disk with a grit of such a type that the surface roughness of the respective cut face 4 produced by grinding (which, as such, actually is a fine surface treatment) is larger than that of the undisturbed bristle shaft surface 20, which respectively surrounds the outwardly protruding particles 19.

Figure 7:
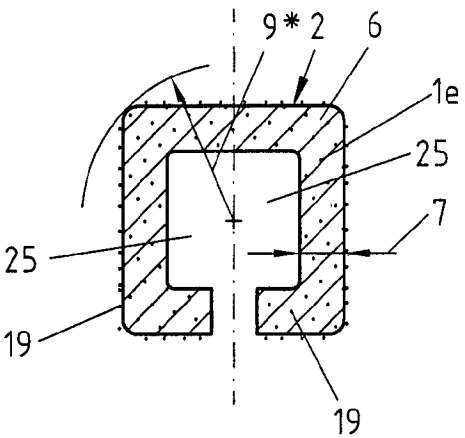
Figure 6:
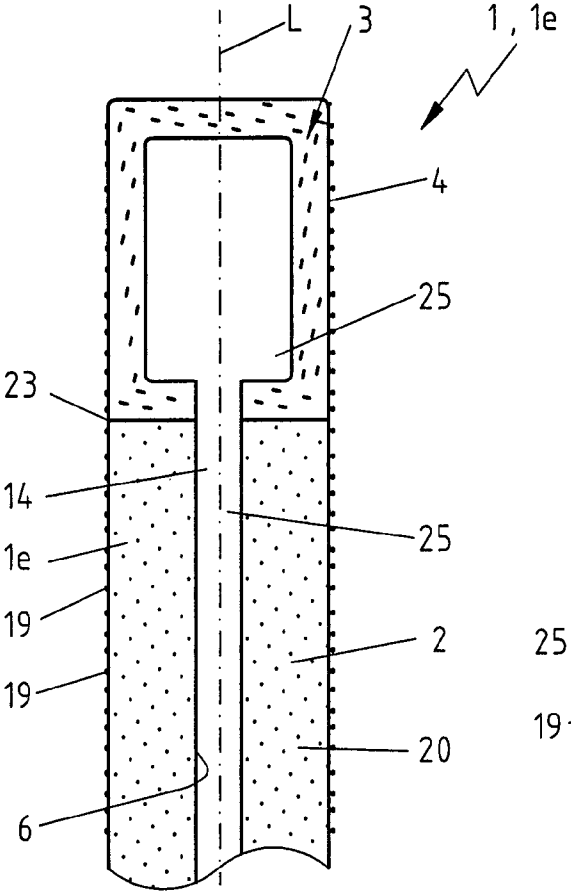

On the other hand, it may be useful to configure the bristles 1 provided with the particles 19 as tube-like, internally hollow, preferably longitudinally slit bristles 1*e*, as is shown by the FIGS. 6 and 7. This internally hollow bristle 1*e* can have a circular cross section. Preferably, it has a non-round, ideally a polygonal cross section. Due to this special configuration as an internally hollow bristle 1*e*, the bristle 1*e* is capable of discharging mascara mass, which has previously been stored in the cavity 25 of the bristle 1*e*, towards the outside in the area of its oblique cut 3. This results in a synergistic effect, because the eyelash W is already pre-coated when the cut face 4 slides along it, i.e. already has received a certain amount of mascara mass when it slides from the cut face 4 into the area of the bristle shaft 2, which retains a thick film of mascara mass due to its roughness and then significantly intensifies the coating of the eyelash W.

When realizing the bristles 1 as internally hollow bristles 1*e* to which particles 19 have been added, a (single) oblique cut is almost always, and preferably even mandatorily, carried out, and not a double oblique cut 3*.

What the advantages are that an oblique cut has in internally hollow bristles 1*e*, why these advantages come to bear, and which mandatory or advantageous configuration options are to be implemented is explained in more detail above.

Figure 12:
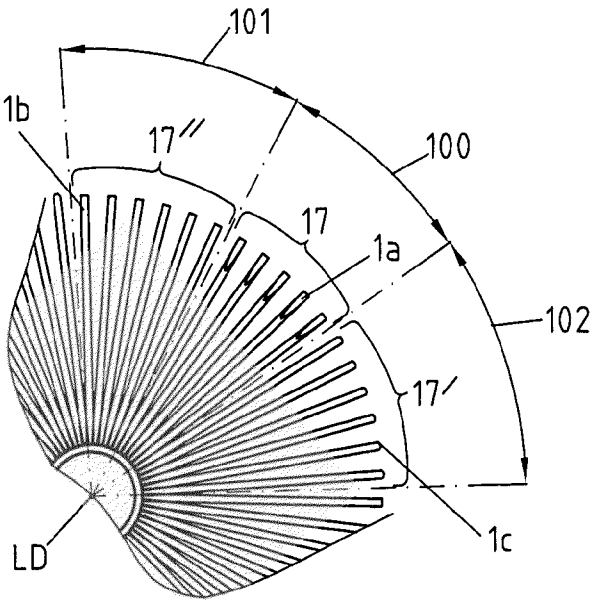
Figure 11:
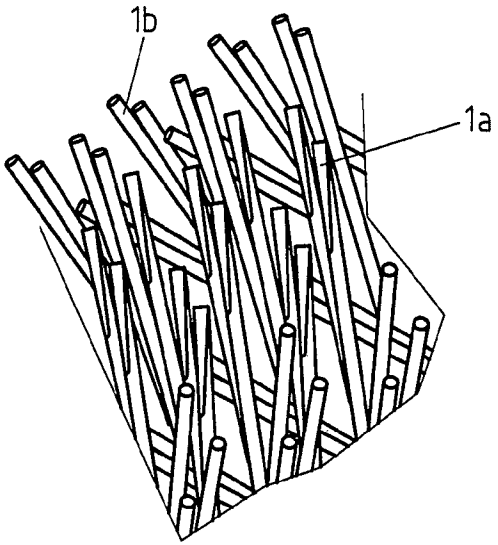
Figure 10:
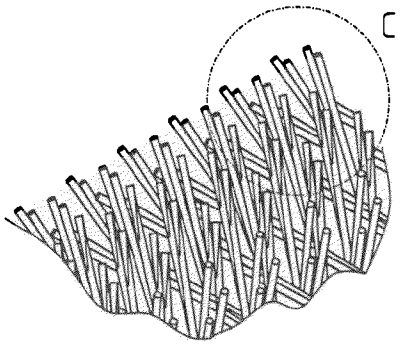

FIGS. 10, 11 and 12 illustrate a variant of the mascara brush according to the invention, with an exceptionally advantageous application and separation action.

As can be seen, the bristle covering 26 in this case consists of bristles 1*a*, 1*c* with a wedge-shaped pointed portion that are formed by filaments 1', and of further bristles 1*b* without a wedge-shaped pointed portion that are also formed from filaments 1', with the bristles 1*a*, 1*c* only differing with regard to the orientation of their cut face 4. The cut face 4 of each of the bristles 1*a* points towards the brush end 16, and the cut face 4 of each of the bristles 1*c* points towards the brush tip 15.

In this case, the bristle covering 26 is configured in such a way that the bristles 1*a* with the wedge-shaped pointed portion, of which several are disposed adjacent to each other in a bristle row 17, form a sector 100 of the bristle covering 26, the bristles 1*c* with the wedge-shaped pointed portion, of which several are disposed adjacent to each other in a bristle row 17', form a sector 102 of the bristle covering 26, and the further bristles 1*b*, disposed in a bristle row 17", form a further sector 101 of the bristle covering 26. In the example illustrated in FIG. 12, the sectors 100 and 102 and the further sector 101 follow each other alternately in the circumferential direction. The sector 102 is followed again by a sector 101. The sequence of sectors is continued until an arc of a circle of 360° is completed over the circumference of the bristle covering 26.

The number of the sectors depends on the individual case of use and the theological properties of the cosmetic used. Preferably, between 1 and 8 sectors 100, 102 and between 1 and 8 further sectors 101 are provided.

Alternatively, there is the option of the filaments 1' or bristles 1*a*, 1*c* with the wedge-shaped pointed portion being disposed in such a way, in the bristle covering 26 that otherwise consists of further filaments 1' or bristles 1, 1*b*, that they form a track extending in a spiral shape on the circumferential enveloping surface of the bristle covering 26, which is not shown here in the Figures.

Ideally, the further filaments 1' or bristles 1*b* are made of the same material as the filaments 1' or bristles 1*a*, 1*c* with a wedge-shaped pointed portion.

In another variant of the mascara applicator previously explained with reference to the Figures, which is also inventive and therefore claimed, the covering is configured in such a way that the chisel faces 4*a* of the filaments 1' or bristles 1*a*, 1*c*, 1*d* with a wedge-shaped pointed portion, neglecting their wedge angle, are orientated perpendicularly to the course of the imaginary longitudinal axis of the spiral-shaped track.

While all the bristles 1*a*, 1*b*, 1*c* of a respective bristle row 17, 17', 17" are identically configured with regard to the configuration of the bristle tip in the exemplary embodiment according to FIG. 12, a bristle row may of course also be formed of bristles that each have differently configured bristle tips. For example, it is possible that bristles 1*a*, 1*b*, 1*c*, or even combinations with bristles 1*d*, 1*e*, 1*f*, are formed next to one another and adjacently in a bristle row, which are disposed in a repeating pattern relative to each other, with the pattern forming a sector, an area or a zone. All logically possible combinations can be realized. Also, sectors, areas or zones may extend in a spiral shape over the circumference of the bristle covering 26 or be disposed, configured and orientated so as to extend in the longitudinal direction of the longitudinal wire core axis LD.

The invention claimed is:

1. A mascara brush, comprising:

an inner core of at least two wire portions twisted together along a longitudinal wire core axis (LD); and a bristle covering of bristles of plastic formed by filaments that are each held clamped between the two wire portions and that are configured at their free ends with a wedge-shaped or without a wedge-shaped bristle tip, wherein the bristles are formed from a plastic material that is extruded to form a fiber and to which outwardly protruding particles are added, and/or that is equipped with point-shaped depressions (indentations) that roughen the bristle surface, wherein the bristles having at their free ends a wedge-shaped bristle tip comprise at least one cut face which forms a wedge and whose surface roughness (Rz) is between 0.2 μm and 6.3 μm.

2. The mascara brush according to claim 1, wherein the surface roughness (Rz) is produced by grinding the bristle ends with a grinding disk.

3. The mascara brush according to claim 1, wherein the surface roughness (Rz) of the respective cut face is greater than a surface roughness of an undisturbed bristle shaft surface comprising the outwardly protruding particles and/or point-shaped depressions (indentations).

4. The mascara brush according to claim 1, wherein each of the bristles has, for a predominant part, a wedge-shaped tip with at least one cut face.

5. The mascara brush according to claim 1, wherein some of the bristles have a wedge-shaped tip, which is formed by an oblique cut, with a cut face.

6. The mascara brush according to claim 1, wherein some of the bristles have a wedge-shaped tip formed by a double oblique cut, which has two cut faces running towards each other which, or the imaginary extensions of which, intersect at or in a area of a free end of a respective bristle.

7. The mascara brush according to claim 1, wherein the at least one cut face is orientated transversely to the longitudinal wire core axis (LD).

8. The mascara brush according to claim 1, wherein the cut faces of the bristles with a cut face are, in part, orientated in a direction towards a brush tip and, in part, towards a brush end opposite the brush tip.

9. The mascara brush according to claim 1, wherein the bristle covering has a plurality of areas, sectors or zones, which are orientated to extend, in a circumferential direction of the bristle covering, transversely to the longitudinal wire core axis (LD), or, in the circumferential direction of the bristle covering, spiral-shaped to the longitudinal wire core axis (LD), or, in a longitudinal direction of the bristle covering, alongside of the longitudinal wire core axis (LD), and which respectively comprise at least one bristle row consisting of a plurality of adjacent bristles that each have an identically configured bristle tip, or are formed by such a bristle row, and which, in the circumferential direction and/or in the longitudinal direction of the bristle covering, are respectively disposed adjacent to one area or sector or zone which comprises a plurality of bristles each having a differently configured bristle tip.

10. The mascara brush according to any claim 1, wherein the bristle covering has a plurality of areas, sectors or zones, which are orientated to extend, in a circumferential direction of the bristle covering, transversely to the longitudinal wire core axis (LD), or, in the circumferential direction of the bristle covering, spiral-shaped to the longitudinal wire core axis (LD), or, in a longitudinal direction of the bristle covering, alongside of the longitudinal wire core axis (LD), and which respectively comprise at least one bristle row which consists of a plurality of adjacent bristles and whose adjacent bristles each have a differently configured bristle tip.

11. The mascara brush according to claim 9, wherein the a plurality of areas, sectors or zones, in the circumferential direction, transversely or longitudinally to the longitudinal wire core axis (LD), sweep over the circumference or a partial area of the circumference of the bristle covering once.

12. The mascara brush according to claim 1, wherein the bristle covering consists of bristles or filaments with a wedge-shaped pointed portion and of further bristles or filaments without a wedge-shaped pointed portion, wherein the bristles or filaments with a wedge-shaped pointed portion form one or more sector(s) of the bristle covering and the further bristles or filaments form one or more further sector(s), the sector(s) and the further sector(s) following each other alternately in a circumferential direction.

13. The mascara brush according to claim 12, wherein between 1 and 8 sectors and between 1 and 8 further sectors are provided.

14. The mascara brush according to claim 12, wherein the bristles or filaments with the wedge-shaped pointed portion are disposed in such a way, in the bristle covering that otherwise consists of further bristles or filaments, that the bristles or filaments with the wedge-shaped pointed portion form a track extending in a spiral shape on a circumferential enveloping surface of the bristle covering.

15. The mascara brush according to claim 12, wherein the further bristles or filaments are made of the same material as the bristles or filaments with a wedge-shaped pointed portion.

16. The mascara brush according to claim 14, wherein chisel faces of the bristles or filaments with a wedge-shaped pointed portion, neglecting their wedge angle, are orientated perpendicularly to a course of an imaginary longitudinal axis of the spiral-shaped track.

17. The mascara brush according to claim 1, wherein, for an angle ($\alpha$) by which the cut face(s) formed by an oblique cut or a double oblique cut is/are inclined relative to a longitudinal bristle axis (L), $\alpha \leq 55°$.

18. The mascara brush according to claim 1, wherein the bristles or filaments are tube-shaped and internally hollow, as well as continuously slit in a direction along their longitudinal axis.

19. The mascara brush according to claim 1, wherein an outer diameter of the bristles with a circular configuration is ≥115 μm and ≤320 μm.

20. The mascara brush according to claim 1, wherein an outer enveloping circle of bristles configured to be non-circular has an enveloping circle diameter which is ≥100 μm and ≤340 μm.

21. The mascara brush according to claim 1, wherein at least a part of the bristles is produced by co-extrusion from a first plastic material and a second plastic material different from the first plastic material, wherein the two plastic materials differ with regard to a modulus of elasticity and/or a Shore D hardness, and wherein the first plastic material has a Shore D hardness ≤80 and/or the second plastic material has a modulus of elasticity of at least 1300 N/mm$^2$, and after a grinding process of the areas respectively consisting of one of the first and second plastic materials, namely the bristle core and the bristle jacket, with one and the same grinding disk, which is carried out for producing the respective cut face, different roughnesses are produced in an area of the bristle core and in an area of the bristle jacket that respectively have a surface roughness (Rz) between 0.2 μm and 6.3 μm.

* * * * *